United States Patent [19]

Busk

[11] Patent Number: 4,694,881

[45] Date of Patent: Sep. 22, 1987

[54] METHOD FOR MAKING THIXOTROPIC MATERIALS

[75] Inventor: Robert S. Busk, Midland, Mich.

[73] Assignee: The Dow Chemical Company, Midland, Mich.

[21] Appl. No.: 326,304

[22] Filed: Dec. 1, 1981

[51] Int. Cl.[4] ..... B22D 17/00; B22D 25/00

[52] U.S. Cl. ..... 164/113; 164/71.1; 164/459; 164/477; 164/900; 72/270; 420/590

[58] Field of Search ..... 164/71.1, 459, 900, 164/477, 113; 420/590; 419/41, 48; 72/262, 272, 270, 253.1

[56] References Cited

U.S. PATENT DOCUMENTS 3,874,207 4/1975 Lemelson ..... 72/270 X

*Primary Examiner*—Kuang Y. Lin

*Attorney, Agent, or Firm*—James H. Dickerson, Jr.

[57] ABSTRACT

A process for forming a liquid-solid composition from a material which, when frozen from its liquid state without agitation, forms a dendritic structure. A material having a non-thioxotropic-type structure, in a solid form, is fed into an extruder. The material is heated to a temperature above its liquidus temperature. It is then cooled to a temperature less than its liquidus temperature and greater than its solidus temperature, while being subjected to sufficient shearing action to break at least a portion of the dendritic structures as they form. Thereafter, the material is fed out of the extruder.

10 Claims, No Drawings

METHOD FOR MAKING THIXOTROPIC MATERIALS

This invention concerns a method for making thixotropic materials.

BACKGROUND OF THE INVENTION

Processes are known for forming a metal composition containing degenerate dendritic primary solid particles homogeneously suspended in a secondary phase having a lower melting point than the primary solids and having a different metal composition than the primary solids. In such thixotropic alloys, both the secondary phase and the solid particles are derived from the same alloy composition. In such processes, the metal alloy is heated to a point above the liquidus temperature of the metal alloy. The liquid metal alloy is thereafter passed into an agitation zone and cooling zone. The liquid alloy is vigorously agitated as it is cooled to solidify a portion of the metal alloy to prevent the formation of the interconnected dendritic networks in the metal and form primary solids comprising discrete, degenerate dendrites or nodules. Surrounding the degenerate dendrites or nodules, is the remaining unsolidified liquid alloy. This liquid-solid metal alloy composition is then removed from the agitation zone. Such mixtures of liquids and solids are commonly referred to as thixotropic alloys. An example of the above described process is shown in U.S. Pat. No. 3,902,544, issued Sept. 2, 1975, to M. C. Flemings, et al.

U.S. Pat. No. 3,936,298 issued Feb. 3, 1976, to Robert Mehrabian, et al. describes a thixotropic metal composition and methods for preparing this liquid-solid alloy metal composition and methods for casting the metal compositions. This patent describes a composite composition having a third component. These compositions are formed by heating a metallic alloy to a temperature at which most or all of the metallic composition is in a liquid state and feeding the liquid metal into a cooling zone where the metal is cooled while being vigorously agitated to convert any solid particles therein to degenerate dendrites or nodules having a generally spheroidal shape. The agitation can be initiated either while the metallic composition is all liquid or when a small portion of the metal is solid, but containing less solid than that which promotes the formation of a solid dendritic network.

The types of thixotropic metals produced in the herein described invention have been described in U.S. Pat. No. 3,902,544 and U.S. Pat. No. 3,936,298. These descriptions of thixotropic-type alloys, as contained in those patents, are herein incorporated by reference. However, the method of making the alloy in the herein described invention is quite different from that described in the two above-mentioned patents.

SUMMARY OF THE INVENTION

The invention is a process for forming a liquid-solid metal composition from a material which, when frozen from its liquid state without agitation, forms dendritic structures. The method comprises feeding a solid having a non-thixotropic structure to a screw extruder, passing the material through a feeding zone and into a heating zone, heating the material to a temperature greater than its liquidus temperature; cooling said material to a temperature less than its liquidus temperature while subjecting it to a shearing action sufficient to break at least a portion of the dendritic structures as they form; and feeding said material out of said extruder. Such a treatment results in a liquid-solid composition which has discrete degenerate dendritic particles or nodules. The particles may comprise up to about 65 weight percent of the liquid-solid material composition. The thixotropic material processed by the herein-described invention may be used in an injection molding process, forging process or in a die casting process.

DESCRIPTION OF THE PREFERRED EMBODIMENTS

In a thixotropic state, the material consists of a number of solid particles, referred to as primary solids and also contains a secondary material. At these temperatures, the secondary material is a liquid material, surrounding the primary solids. This combination of materials results in a thixotropic material.

It is known in the art that thixotropic-type metal alloys may be prepared by subjecting a liquid metal alloy to vigorous agitation as it is cooled to a temperature below its liquidus temperature. Such a process if shown in U.S. Pat. No. 3,902,544, issued Sept. 2, 1975, to M. C. Flemmings et al. It would be very desirable to produce a thixotropic-type metal alloy in a one-step process by feeding a solid metal alloy and extracting a thixotropic metal alloy. Such a process has heretofore been unknown in the art. The present invention provides a process whereby a non-thixotropic-type metal alloy may be fed into an extruder and will produce, therein, a thixotropic metal alloy.

The composition of this invention can be formed from any material system or pure material regardless of its chemical composition which, when frozen from liquid state without agitation forms a dendritic structure. Even through pure materials and eutectics melt at a single temperature, they can be employed to form the composition of this invention since they can exist in liquid-solid equilibrium at the melting point by controlling the net heat input or output to the melt so that, at the melting point, the pure material or eutectic contains sufficient heat to fuse only a portion of the metal or eutectic liquid. This occurs since complete removal of heat of fusion in a slurry employed in the casting process of this invention cannot be obtained instantaneously due to the size of the casting normally used and the desired composition is obtained by equating the thermal energy supplied, for example by vigorous agitation, and that removed by a cooler surrounding environment.

The herein described invention is suitable for any material that forms dendritic structures when the material is cooled from a liquid state into a solid state without agitation. Representative materials include pure metals and metal alloys such as lead alloys, magnesium alloys, zinc alloys, aluminum alloys, copper alloys, iron alloys, nickel alloys and cobalt alloys. The solidus and liquidus temperatures of such alloys are well known in the art. The invention is also operable using non-metals such as sodium chloride, potassium chloride, and water. It is also useful for non-metal mixtures and solutions such as water-salt and water-alcohol solutions and mixtures.

A preferred embodiment of the invention is its use for metals and metal alloys. Hereinafter, the invention will be described as being used for processing metal alloys. However, the same processing steps are applicable for other types of materials.

In the practice of the invention, a nonthixotropic metal alloy is used. That is, the alloys which have a dendritic structure. Conveniently, the nonthixotropic alloy may be formed into particles or chips of a convenient size for handling. The size of the particles used is not critical to the invention. However, because of heat transfer and handling, it is preferred that a relatively small particle size be used.

The shear required in the present invention may be provided in a number of ways. Suitable methods include, but are not limited to screw extruders, rotating plates and high speed agitation.

A convenient way for processing the herein described metal alloy is by the use of an extruder. There are numerous types of extruders on the market. A torturous path extruder is suitable in the present invention. However, a screw extruder is preferred. In a screw extruder the material is fed from a hopper through the feed throat into the channel of the screw. The screw rotates in a barrel. The screw is driven by a motor. Heat is applied to the barrel from external heaters, and the temperature is measured by thermocouples. As the material is conveyed along the screw channel, it is heated sufficiently to form a liquid. Thereafter, it is cooled to a temperature below its liquidus temperature while it is subjected to shearing.

Extruder barrels may be heated electrically, either by resistance or induction heaters, or by means of jackets through which oil or other heat-transfer media are circulates.

The temperature control on the metal alloy passing through the extruder may conveniently be done using a variety of heating mechanisms. An induction coil type heater has been found to work very well in the invention.

The size of single-screw extruders is described by the inside diameter of the barrel. Common extruder sizes are from 1 to 8 inches. Larger machines are made on a custom basis. Their capacities range from about 5 lb/hr for the 1-inch diameter unit to approximately 1,000 lb/hr for 8-inch diameter machines.

The heart of the preferred extruder is the screw. Its function is to convey material from the hopper and through the channel.

The barrel provides one of the surfaces for imparting shear to the material and the surface through which external heat is applied to the material. They should be designed to provide an adequate heat-transfer area and sufficient opportunity for mixing and shearing.

The extruder is divided into several heating and cooling zones. The first zone the material encounters upon entering the extruder is a feeding zone. This zone is connected with a heating zone, where the material is heated to a temperature above its liquidus temperature. Thereafter, the material is conveyed into a third zone. The third zone is a cooling zone. In this zone, the material is cooled to a temperature less than its liquidus temperature. In this zone, the material is subjected to shearing forces. The shearing forces should be of a degree sufficient to break up at least a portion of the dendritic structures as they form. In the cooling zone the thixotropic-type metal structure is formed. After the cooling zone, the material is conveyed out of the extruder. The amount of solids in the resulting material is up to about 65 weight percent of the solid-liquid composition. Preferred, are materials having from about 20 to about 40 weight percent solids.

In the operation of the herein-described process, the material to be processed is granulated to a size which may be accomodated conveniently by the screw extruder. The granulated material may be placed into a preheat hopper. If the material to be processed is easily oxidized, then the hopper may be sealed and a protective atmosphere may be placed around the material to minimize oxidation. For example, if the material is a magnesium alloy, argon has been found to be a convenient protective atmosphere. The material to be processed may be preheated while it is in the preheat hopper or it may be fed at ambient temperature into the screw extruder. If the material is to be preheated, it may be heated as high as temperatures which approach the solidus temperature of the metal alloy. Convenient preheat temperatures can range from 50° C. to 500° C. for magnesium alloys. Before material is fed into the screw extruder, the screw extruder may be heated to a temperature near or above the liquidus temperature of the metal alloy to be processed. If a protective atmosphere is needed, the protective gas should be flowed through the screw extruder as well as through the preheat hopper. After the extruder cylinder has reached operating temperatures, feed from the preheat hopper to the extruder is started. A zone is required which will prevent liquid material from entering the area of the screw where the solid material is fed to the screw extruder. This first zone is hereinafter referred to as a feeding zone. The feeding zone contains solid material and substantially prevents liquid material from entering the area. Liquid material is formed in a heating zone. As the material flows through the second zone of the screw extruder, the temperature of the metal is raised, by externally applied heat and by friction in the barrel, to a temperature above its liquidus temperature. The screw extruder moves the material into a third zone, a cooling zone, by the turning of the screw toward the end of the extruder. In this zone, the material is cooled to a temperature below its liquidus temperature. During this cooling, the material is subjected to a shear. The temperature of the metal should be measured and controlled as it flows through the extruder. The temperature and the shearing action of the extruder cause a thixotropic metal alloy to be formed. At this point, the thixotropic metal exists the extruder and may be processed in a variety of ways.

The shear exerted by the extruder occurs, for example, when the metal alloy, passing through the extruder, is forced to flow through small channels on its way toward the exit. Additional shear is encountered because a portion of the alloy adheres to the wall and is removed from the wall by the action of the screw. This adherence and removal by the screw results in shearing action on the metal alloy. The degree and amount of shearing action required in the herein described process are variable. Sufficient shearing action is required to break at least a portion of the dendritic structure of the metal alloy, as it forms.

As has been mentioned, it is possible to injection mold material produced in the herein-described process. If injection molding is desired, the injection molding machine, used to injection mold the thixotropic material, may itself be used as an apparatus to process the material to form thixotropic alloys. It is unnecessary to process the material in an extruder prior to it being fed into an injection molding machine. Rather, metal alloys having a dendritic structure may be fed directly into an injection molding machine. The material should be heated as it passes through the machine and subjected to shear forces exerted by the screw in the injection molding machine. As with the description of the extruder, the temperature of the material should be greater than its liquidus temperature before being cooled and subjected to shear. This temperature control, in conjunction with the shear forces exerted by the injection molding machine, break up at least a portion of the dendritic structures in the metal alloy as they form. This converts the non-thixotropic metal alloy into a thixotropic metal alloy.

A convenient type of injection molding machine to use in the herein-described process is a reciprocating screw injection molding machine. The steps of the molding process for a reciprocating screw machine with an hydraulic clamp are:

1. Material is put into a hopper.

2. Oil behind a clamp ram moves a moving platen, closing the mold. The pressure behind the clamp ram builds up, developing enough force to keep the mold closed during the injection cycle. If the force of the injecting material is greater than the clamp force, the mold will open. Material will flow past a parting line on the surface of the mold, producing "flash" which either has to be removed or the piece has to be rejected and reground.

3. The material is sheared primarily by the turning of the screw. The material is heated as it passses through the machine. As the material is heated, it moves forward along the screw flights to the front end of the screw. The pressure generated by the screw on the material forces the screw, screw drive system, and the hydraulic motor back, leaving a reservoir of material in front of the screw. The screw will continue to turn unitl the rearward motion of the injection assembly hits a limit switch, which stops the rotation. This limit switch is adjustable, and its location determines the amount of material that will remain in front of the screw (the size of the "shot").

The pumping action of the screw also forces the hydraulic injection cylinders (one of each side of the screw) back. This return flow of oil from the hydraulic cylinders can be adjusted by the appropriate valve. This is called "back pressure", which is adjustable from zero to about 400 psi.

4. Most machines will retract the screw slightly at this point to decompress the material so that it does not "drool" out of the nozzle. This is called the "suck back" and is usually controlled by a timer.

5. Two hydraulic injection cylinders now bring the screw forward, injecting the material into the mold cavity. The injection pressure is maintained for a predetermined length of time. Most of the time there is a valve at the tip of the screw that prevents material from leaking into the flights of the screw during injection. It opens when the screw is turning, permitting the material to flow in front of it.

6. The oil velocity and pressure in the two injection cylinders develop enough speed to fill the mold as quickly as needed and maintain sufficient pressure to mold a part free from sink marks, flow marks, welds, and other defects.

7. As the material cools, it becomes more viscous and solidifies to the point where maintaining injection pressure is no longer of value.

8. Heat may be continually removed from the mold by circulating cooling media (usually water) through drilled holes in the mold. The amount of time needed for the part to solidify so that it might be ejected from the mold is set on the clamp timer. When it times out, the moveable platen returns to its original position, opening said mold.

9. An ejection mechanism separates the molded part from the mold and the machine is ready for its next cycle.

Additionally, the material may be formed into parts using die casting machines. Preferred types of die casting machines are cold chamber high pressure die casting machines and centrifugal casting machines. High pressure die casting machines generally operate at injection pressures in excess of about 1,000 pounds per square inch.

Also, the material formed in the herein-described invention, may be formed into parts using conventional forging techniques.

The herein-described invention is concerned with generally horizontal screw extruders. Liquid feed will not work with such extruders. Thus, the feed material must be in a solid state.

The herein-described invention is illustrated in the following example.

EXAMPLE 1

A non-thixotropic magnesium alloy, AZ91B was processed into a thixotropic alloy. Magnesium alloy AZ91B has a liquidus temperature of 596° C. and a solidus temperature of 468° C. The nominal composition for magnesium alloy AZ91B is 9 percent aluminum, 0.7 percent zinc, 0.2 percent manganese, with the remainder being magnesium.

The magnesium alloy AZ91B was formed into chips having an irregular shape with an appropriate mesh size of about 50 mesh or larger. A quantity of AZ91B alloy chips were placed in a preheat hopper which was attached to a screw extruder. The hopper was sealed and an inert atmosphere of argon was placed internally to minimize oxidation of the magnesium AZ91B alloy. The AZ91B alloy chips were fed into the chamber of a screw extruder. The inside diameter of the screw extruder chamber was 2¼ inches. The screw was made of AISI H-21 steel and heat treated. The cylinder, likewise was made AISI H-21 steel and heat treated. The screw had a constant pitch of 2.25 inches, a constant root of 1.591 inches, and a total length of 44.3 inches. A ten horsepower, 1800 rpm motor provided power to the screw through a gear box. The gear box turned the screw at a rate of from about 0 rpm to about 27 rpm. Twenty-two thermocouples were fastened to the surface of the screw cylinder and 22 were imbedded into the cylinder about 1/16 of an inch from the inside interior surface.

The extruder screw rpm was set at 15.1. The extruder was starve fed at a feed rate of AZ91B alloy of about 22 pounds per hour. The temperature of the alloy as it passed through the screw extruder reached a maximum temperature of 620° C. This is above the liquidus temperature of AZ91B alloy. The AZ91B alloy was then cooled to a temperature of 581° C. while being subjected to shear. The material was then extruded from the end of an extruder through an orifice. The material was converted from an alloy having a dendritic structure to an alloy having a thixotropic-type liquid-solid structure. the melt temperature was 585° C. which corresponds to a weight percent solids of about 20 percent.

What is claimed is:

1. A process for the production of liquid-solid material comprising (a) feeding a solid material having a dendritic structure into a screw extruder; (b) passing said material through a feeding zone in the extruder; (c) heating said material to a temperature greater than its liquidus temperature as it passes through a heating zone in the extruder; (d) cooling said material to within a temperature range of greater than the solidus and less than the liquidus temperature of the material; (e) shearing said cooled material in the extruder with the screw at a force sufficient to break at least a portion of the dendritic structures as they form; and (f) removing said material from said extruder.

2. A process for the production of liquid-solid metal alloy comprising (a) feeding a solid metal alloy having dendritic structures into a screw extruder; (b) passing said alloy through a feeding zone in the extruder; (c) heating said metal alloy to a temperature greater than its liquidus temperature as it passes through a heating zone in the extruder; (d) cooling said alloy to a temperature range of greater than the solidus and less than the liquidus temperatures of the alloy; (e) shearing said cooled metal alloy with the screw at a force sufficient to break at least a portion of the dendritic structures as they form; and (f) removing said alloy from said extruder.

3. The process of claim 2 wherein the solid metal alloy is a magnesium alloy.

4. The process of claim 3 wherein the magnesium alloy is AZ91B.

5. The process of claim 2 wherein the alloy fed out of said extruder contains up to about 65 weight percent solids.

6. The process of claim 2 wherein a high pressure, cold chamber die casting machine is used to form the removed alloy.

7. The process of claim 1 or 2 where the extruder is an injection molding machine.

8. The process of claim 2 including forming the removed alloy by injection molding.

9. The process of claim 2 including forming the removed alloy by forging.

10. A process for the production of a liquid-solid metal alloy comprising (a) feeding solid metal alloy having dendritic structures into an extruder; (b) passing said alloy through a feeding zone in the extruder; (c) heating said metal alloy to a temperature greater than its liquidus temperature as it passes through a heating zone in the extruder; (d) cooling said alloy to a temperature range of greater than the solidus temperature and less than the liquidus temperature of the alloy; (e) shearing said cooled metal alloy with rotating plates at a force sufficient to break at least a portion of the dendritic structures as they form; and (f) removing said alloy from said extruder.

* * * * *